US010076836B2

(12) United States Patent
Reinhart

(10) Patent No.: US 10,076,836 B2
(45) Date of Patent: Sep. 18, 2018

(54) SAWHORSE AND KIT

(71) Applicant: Creative Plastic Concepts, LLC, Sycamore, OH (US)

(72) Inventor: Nickolas Reinhart, Findlay, OH (US)

(73) Assignee: Creative Plastic Concepts, LLC, Sycamore, OH (US)

( * ) Notice: Subject to any disclaimer, the term of this patent is extended or adjusted under 35 U.S.C. 154(b) by 105 days.

(21) Appl. No.: 14/887,395

(22) Filed: Oct. 20, 2015

(65) Prior Publication Data

US 2016/0107305 A1 Apr. 21, 2016

Related U.S. Application Data

(60) Provisional application No. 62/066,555, filed on Oct. 21, 2014.

(51) Int. Cl.

| | |
|---|---|
| ***B25H 1/06*** | (2006.01) |
| ***E06C 1/30*** | (2006.01) |
| ***A47B 9/14*** | (2006.01) |
| ***B25H 1/00*** | (2006.01) |
| ***B27B 21/00*** | (2006.01) |
| ***B25H 1/16*** | (2006.01) |

(52) U.S. Cl.

CPC ..... *B25H 1/06* (2013.01); *A47B 9/14* (2013.01); *B25H 1/00* (2013.01); *B25H 1/16* (2013.01); *B27B 21/00* (2013.01); *E06C 1/30* (2013.01)

(58) Field of Classification Search

USPC ..... 269/309; 182/181.1, 182.1, 182.2, 182.3, 182/186.5

See application file for complete search history.

(56) References Cited

U.S. PATENT DOCUMENTS

| | | | | | |
|---|---|---|---|---|---|
| 414,903 | A | * | 11/1889 | Godillot | 248/118.5 |
| 488,349 | A | * | 12/1892 | Bradley | 52/641.1 |
| 638,987 | A | * | 12/1899 | Porten | B25H 1/06 182/153 |
| 1,226,112 | A | * | 5/1917 | Pepin et al. | B25H 1/06 182/153 |
| 1,398,471 | A | * | 11/1921 | Smart | B25H 1/06 182/226 |

(Continued)

OTHER PUBLICATIONS

TaskHorse found at http://www.woodworkingtalk.com/f27/best-sawhorse-ive-ever-used-16622/ Jul. 2010, attached as pdf.*

(Continued)

*Primary Examiner* — Joseph J Hail
*Assistant Examiner* — Brian D Keller
(74) *Attorney, Agent, or Firm* — Jacob M. Ward; Ward Law Office LLC

(57) ABSTRACT

An extendable sawhorse includes a main body having a platform and a plurality of receiving members depending therefrom. The sawhorse is adjustable between an extended arrangement and a condensed arrangement. A plurality of extension members are interchangeably coupled to each of the receiving members in the extended arrangement. The extendable sawhorse further includes a plurality of feet having a first end and a second end. The first end of the feet is coupled to the extension members in the extended arrangement and the second end of the feet is coupled to legs in the condensed arrangement.

13 Claims, 5 Drawing Sheets

(56) References Cited

U.S. PATENT DOCUMENTS 2,257,876 A * 10/1941 Berchem ..... E04G 1/34 182/153
2,343,557 A * 3/1944 Johnson ..... B25H 1/06 182/186.1
2,825,606 A * 3/1958 Rebensdorf ..... B25H 1/06 182/153
2,916,239 A * 12/1959 Stopps ..... B65D 19/0051 108/53.3
3,081,841 A * 3/1963 Mauro ..... A47B 13/021 182/224
3,110,360 A * 11/1963 Hearn ..... B25H 1/06 182/155
3,951,233 A * 4/1976 Meyers ..... B25H 1/06 182/155
4,238,001 A * 12/1980 Alexander ..... B25H 1/06 16/263
4,565,263 A * 1/1986 Southworth ..... F16M 13/00 182/182.5
4,756,385 A * 7/1988 Deitz ..... B25H 1/06 182/153
4,770,274 A * 9/1988 Middleton ..... B25H 1/06 182/186.3
4,877,109 A * 10/1989 Welch ..... B25H 1/06 182/182.4
4,890,693 A * 1/1990 O'Brien ..... B25H 1/06 182/151
5,377,779 A * 1/1995 Slapnicka ..... E04G 1/34 182/153
5,402,860 A * 4/1995 Fry ..... B25H 1/06 182/153
5,439,073 A * 8/1995 Johnson ..... A47B 3/0818 182/153
5,484,037 A * 1/1996 Neumarkel ..... E04G 1/32 182/185.1
5,628,382 A * 5/1997 Hill ..... B25H 1/06 182/153
5,720,362 A * 2/1998 Denkins ..... B25H 1/04 182/182.2
6,019,193 A * 2/2000 Brown ..... B25H 1/06 182/153
6,021,866 A * 2/2000 Meeks ..... B25H 1/06 182/153
6,070,696 A * 6/2000 Chubb ..... B23D 45/024 182/181.1
6,092,627 A * 7/2000 Burger ..... B25H 1/06 182/153
6,155,318 A * 12/2000 Underwood ..... B23D 47/025 144/286.1
6,164,413 A * 12/2000 Sagol ..... B25H 1/16 182/153
6,237,506 B1 * 5/2001 Forbes ..... B61D 3/16 105/355
6,283,250 B1 * 9/2001 Asher ..... B25H 1/06 182/153
6,286,824 B1 * 9/2001 Sagol ..... B25H 1/04 269/900
6,305,498 B1 * 10/2001 Itzkovitch ..... B25H 1/06 182/129
6,761,340 B2 * 7/2004 Shaw ..... A47B 95/043 182/108
6,929,096 B1 * 8/2005 Goldberg ..... A47B 13/06 108/156
7,484,700 B2 * 2/2009 Selle ..... A47B 91/024 248/188.4
8,016,079 B1 * 9/2011 Huls ..... B25H 1/06 182/152
8,113,316 B2 * 2/2012 Sward ..... G01N 33/497 108/62
8,708,103 B2 * 4/2014 Bulley ..... B25H 1/06 182/153
8,869,937 B2 * 10/2014 Lampe ..... E06C 7/50 182/154
D722,183 S 2/2015 Reinhart
9,140,401 B2 * 9/2015 Hoyle ..... F16M 11/00
2002/0189900 A1 * 12/2002 Bremick ..... E06C 7/48 182/108
2005/0051940 A1 * 3/2005 Bensman ..... B25H 1/16 269/139
2005/0230188 A1 * 10/2005 Berg ..... B25H 1/06 182/153
2010/0006011 A1 * 1/2010 Cruz ..... B25H 1/16 108/60
2010/0084221 A1 * 4/2010 Cuccio ..... B25H 1/08 182/129
2012/0193501 A1 * 8/2012 Lai ..... B25H 1/16 248/423

OTHER PUBLICATIONS

Michigan Rubber Feet, found at https://www.ebay.com/itm/Michigan-360200-Rubber-Ladder-Shoes-Feet-Wood-Single-Extension-Ladders-/152391259186, May 2013, attached as pdf.*

* cited by examiner

SAWHORSE AND KIT

CROSS-REFERENCE TO RELATED APPLICATIONS

This application claims the benefit of U.S. Provisional Application No. 62/066,555 filed on Oct. 21, 2014. The entire disclosure of the above application is hereby incorporated herein by reference.

FIELD

The disclosure generally relates to sawhorses, in particular, an extendable sawhorse and related kit.

BACKGROUND

Sawhorses are commonly used by carpenters, construction workers, mechanics, or handypersons for woodworking, new construction, remodeling, maintenance, or the like. The sawhorses typically include a platform for supporting a workpiece and legs for supporting the platform.

Typically, sawhorses may not be easily adjustable to accommodate a variety of applications that may require varying height profiles of the sawhorse. For example, certain applications may require a sawhorse with a high profile or high height arrangement. Other applications may require a sawhorse with a low profile or low height arrangement.

Additionally, in order to accommodate a variety of applications, it is important for the sawhorses to be strong, steady, and level. Sometimes, due to a downwards force applied to the sawhorse in use, the legs may begin to splay. The splaying of the legs may cause damage to the sawhorse or make it difficult to optimally use the sawhorse as desired.

There is a continuing need for an adjustable sawhorse that minimizes manufacturing and assembly complexity and cost thereof. Desirably, the sawhorse is strong, steady, level, and readily adjustable to accommodate a variety of applications.

SUMMARY

In concordance with the instant disclosure, an adjustable sawhorse that minimizes manufacturing and assembly complexity, and which is strong, steady, level, and readily adjustable to accommodate a variety of applications, has surprisingly been discovered.

In one embodiment, an extendable sawhorse includes a main body having a platform and a plurality of receiving members depending from the platform. The sawhorse is adjustable between an extended arrangement and a condensed arrangement. The extendable sawhorse further includes a plurality of feet having a receptacle and a plug. The receptacle of each of the feet has an opening formed therein. The plug is configured to be received within one of the receiving of the main body.

In another embodiment, a kit for an extendable sawhorse includes a main body including a platform and a plurality of receiving members depending from the platform. A plurality of extension members is configured to be interchangeably coupled to each of the receiving members. A plurality of feet are configured to be coupled to either the legs or the extension members. The feet include a receptacle formed at a first end thereof and a plug formed at a second end thereof.

In yet another embodiment, an extendable sawhorse configurable in an extended arrangement and in a condensed arrangement includes a main body having a platform and a plurality of receiving members depending from the platform. A plurality of extension members are included and are configured to be interchangeably coupled to each of the receiving members. The sawhorse further includes a plurality of feet. Each of the feet includes a receptacle and a plug. The receptacle has an opening formed therein, and the plug is configured to be received within one of the receiving members. In the extended arrangement, a first end of each of the extension members is received in one of the receiving members, and a second end of each of the extension members is received in the receptacle of the foot. In the condensed arrangement, the extension members are removed and the plugs of the feet are received in the receiving members.

DRAWINGS

The above, as well as other advantages of the present disclosure, will become readily apparent to those skilled in the art from the following detailed description, particularly when considered in the light of the drawings described hereafter.

DETAILED DESCRIPTION

Figure 2:
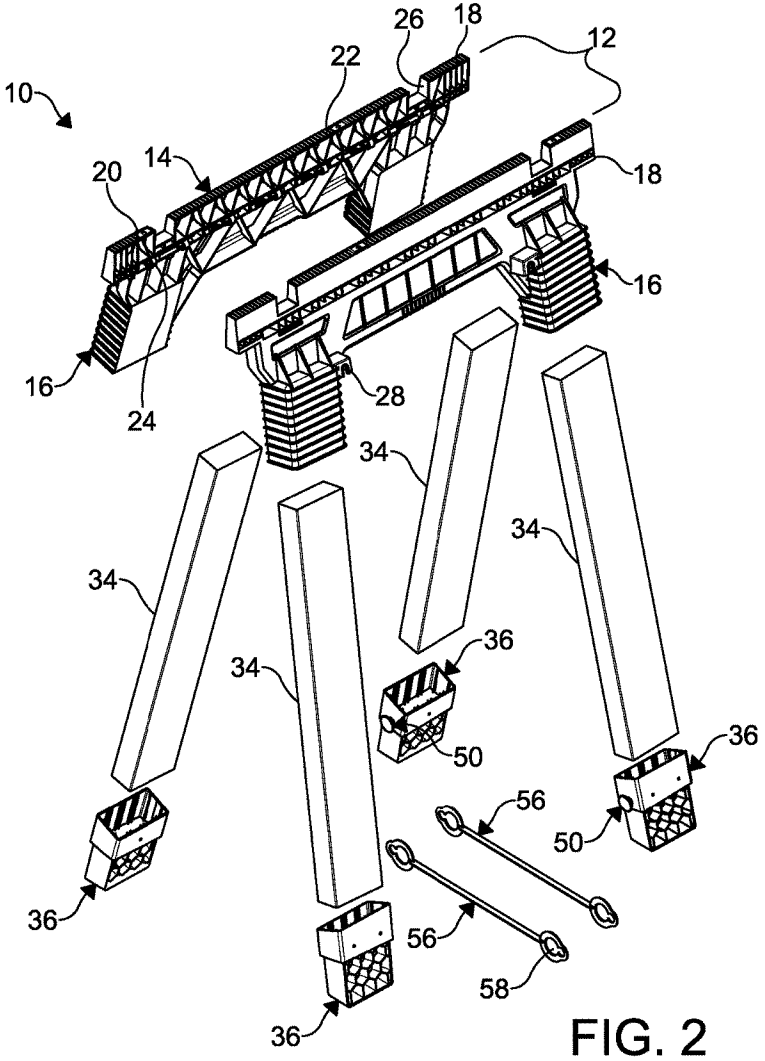
FIG. 2 is an exploded perspective view of the sawhorse shown in FIG. 1.
Figure 1:
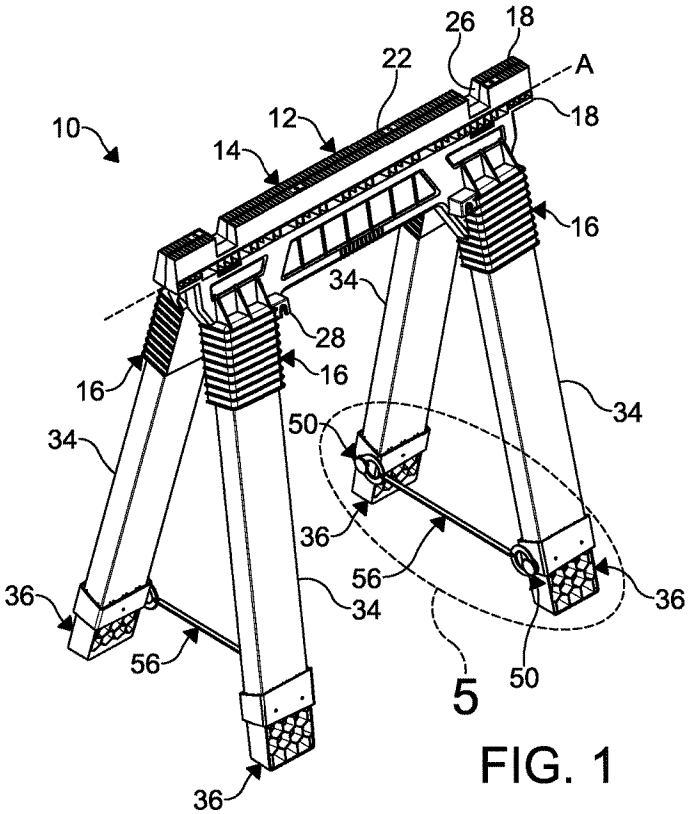
FIG. 1 is a perspective view of a first embodiment of a sawhorse according to the instant disclosure, the sawhorse shown in an extended arrangement.
Figure 3:
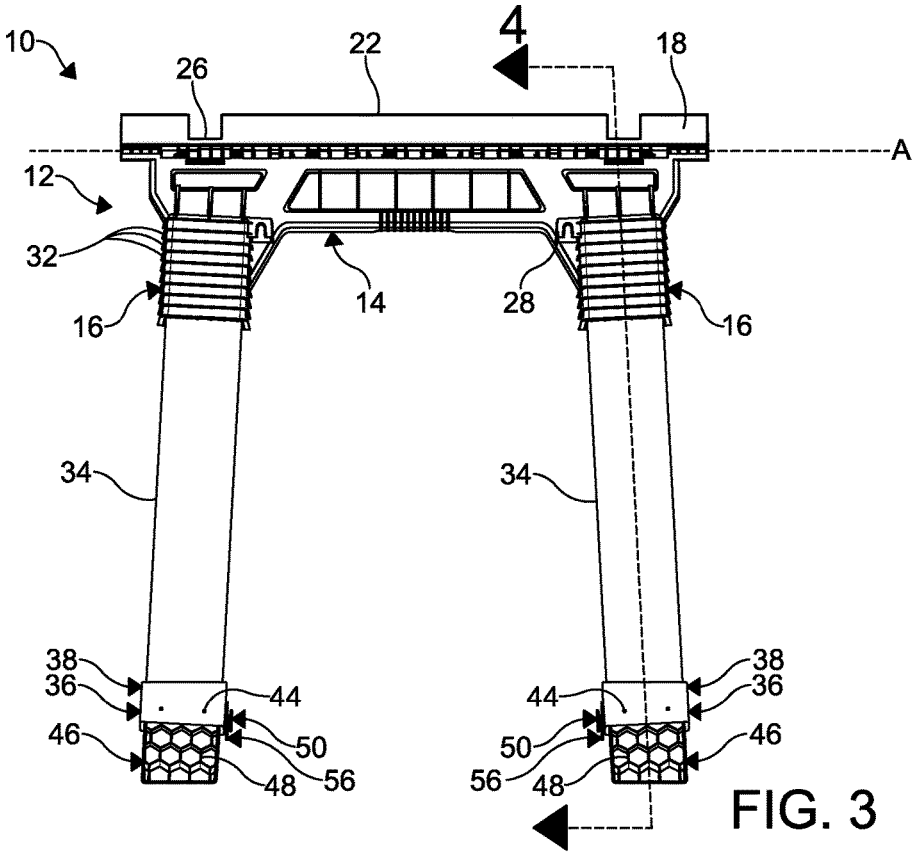
FIG. 3 is a right side elevational view of the sawhorse shown in FIG. 1.
Figure 4:
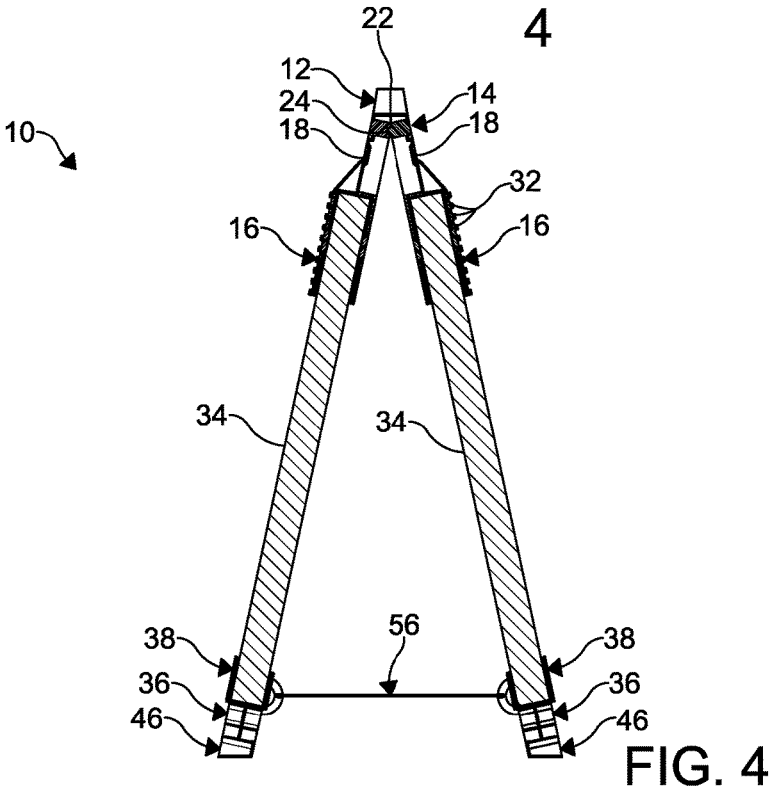
FIG. 4 is a cross-sectional view of the sawhorse taken at section line 4-4 in FIG. 3.
Figure 5:
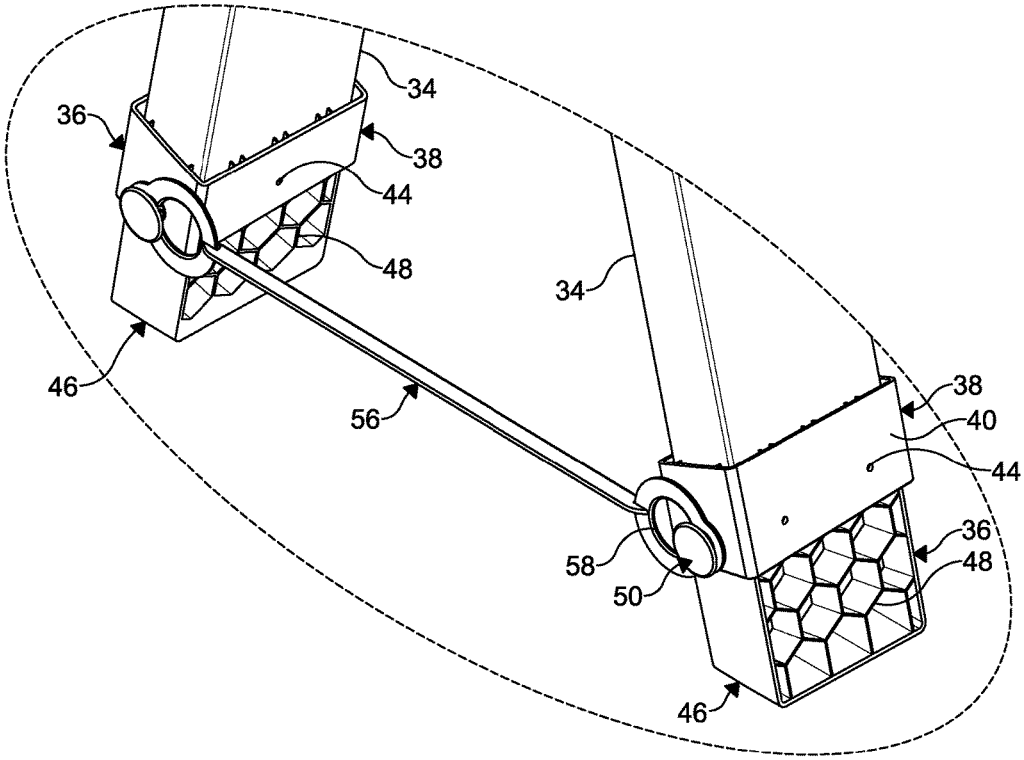
FIG. 5 is an enlarged, fragmentary, perspective view of the sawhorse taken at area 5 in FIG. 1.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical unless otherwise disclosed.

FIGS. 1-10 illustrate a sawhorse 10 according the present disclosure. The sawhorse 10 is adjustable between an extended arrangement, shown in FIGS. 1-5, and a condensed arrangement, shown in FIGS. 7-10. The extended arrangement is used for applications requiring a sawhorse 10 with a high profile with respect to a floor or resting surface for the sawhorse 10. The condensed arrangement is used for applications requiring a sawhorse 10 with a low profile with respect to a floor or resting surface for the sawhorse 10.

As shown in FIGS. 1-4 and 7-10, the sawhorse 10 includes a main body 12 having a platform 14. The sawhorse 10 also has a plurality of receiving members 16 spaced apart from each other and depending from the main body 12.

The platform 14 of the main body 12 may include a pair of support members 18. The support members 18 may be formed separately or together as a one-piece unitary construction, as desired. In the embodiment shown in FIG. 2, each of the support members 18 includes at least an inner surface 20 and an upper support surface 22. The inner surfaces 20 of the support members 18 are hingedly coupled to each other along a longitudinal axis A. Each of the support members 18 includes a plurality of hinge knuckles 24 formed on the inside surface. The hinge knuckles 24 of a first one of the support members 18 cooperate with the hinge knuckles 24 of a second one of the support members 18 to allow the support members 18 to pivot with respect to each other along the longitudinal axis A.

It should be appreciated that, by being formed of two hingedly-coupled support members 18, the platform 14 is configurable between an open position, as shown in FIGS. 1-5 and 7-10, and a closed position (not shown). In the open position, the receiving members 16 at each end of the main body 12 are spaced apart from each other in an A-shaped configuration. In the closed position, the receiving members 16 of each end are positioned adjacent each other, for example.

The upper support surface 22 of each support member 18 may include at least one recess 26 formed therein. When the support members 18 are coupled to each other, the recesses 26 of the first support member 18 and the second support member 18 align with each other to form a substantially continuous channel across the platform 14.

Each support member 18 may include at least one hanging feature 28 formed thereon. The hanging feature 28 is configured to facilitate hanging of the sawhorse 10 during storage. In the illustrated embodiment, the hanging feature 28 is a downward-opening hollow body having a downward-opening slot formed in an outward facing sidewall thereof. The slot is configured to retain a portion of hanger, such as a nail or hook, within the hollow body of the hanging feature 28. Other configurations of hanging features 28 will be appreciated by those of ordinary skill in the art.

In the illustrated embodiment, four of the receiving members 16 are arranged in pairs at opposing ends of the platform 14. It will be understood by those of ordinary skill in the art that any number of receiving members 16 may be included on the platform 14, and that other arrangements of the receiving members 16 may also be utilized, as desired.

The receiving members 16 include a cavity 30 (shown in FIG. 8) configured to receive an extension member 34 therein. A plurality of ribs 32 may be formed on sidewalls of the receiving members 16. The ribs 32 advantageously increase strength of the receiving members 16, thereby minimizing deformation and failure during use.

The platform 14 and the receiving members 16 may be integrally formed with each other by a plastic injection molding process. However, the receiving members 16 may be separately formed and coupled to the platform 14 by a fastening means, such as adhesive or mechanical fasteners. The main body 12 may further include gussets connecting the platform 14 to the receiving members 16. Additionally, other suitable materials and processes may be used to form the platform 14 and the receiving members 16.

With renewed reference to FIGS. 1-5, in the extended arrangement, a plurality of the extension members 34 are received in and extend from each of the receiving members 16. The extension members 34 may be formed from a wood material, as a non-limiting example. For example, the wood material can be a conventional piece of 2×4 lumber having a thickness substantially equal to 1½ inches and a width substantially equal to 3½ inches. The lumber is desirably strong to support various applications, low cost to manufacture, and is easily available in various standard lengths or customizable to various desirable lengths.

Although wood material such as standard lumber may be most convenient, it is understood that any suitable material can be employed for the extension members 34 as desired, including plastic, metal, and composite members. Other standard sizes of lumber other than 2×4 lumber may also be employed. The length of the extension members 34 can be any length such as 24 inches, 12 inches, 6 inches, or any other length as desired.

Referring now to FIGS. 1-10, the sawhorse 10 includes a plurality of feet 36. Advantageously, the feet 36 are configured to couple to the extension members 34 when the sawhorse 10 is in the extended arrangement, and to the receiving members 16 when the sawhorse 10 is in the condensed arrangement.

Figure 6:
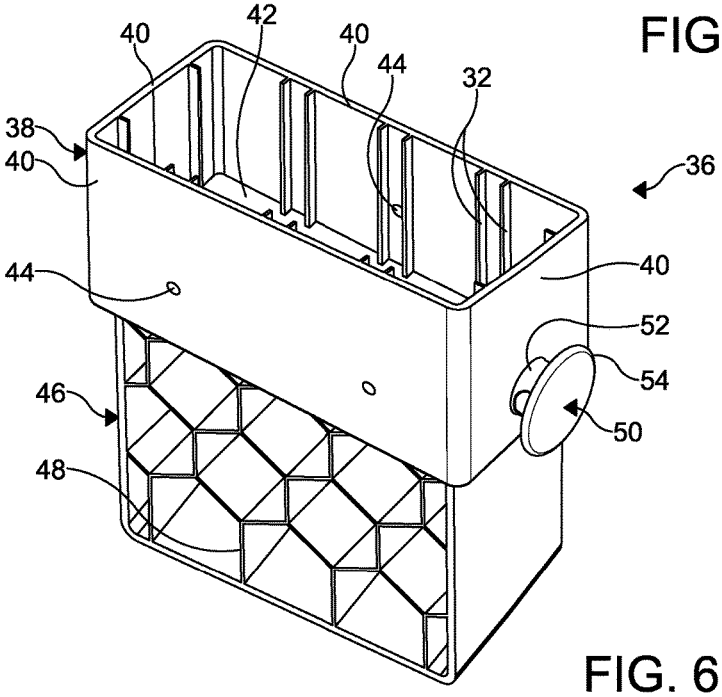
FIG. 6 is an enlarged, perspective view of a foot of the sawhorse shown in FIGS. 1-5.
Figure 7:
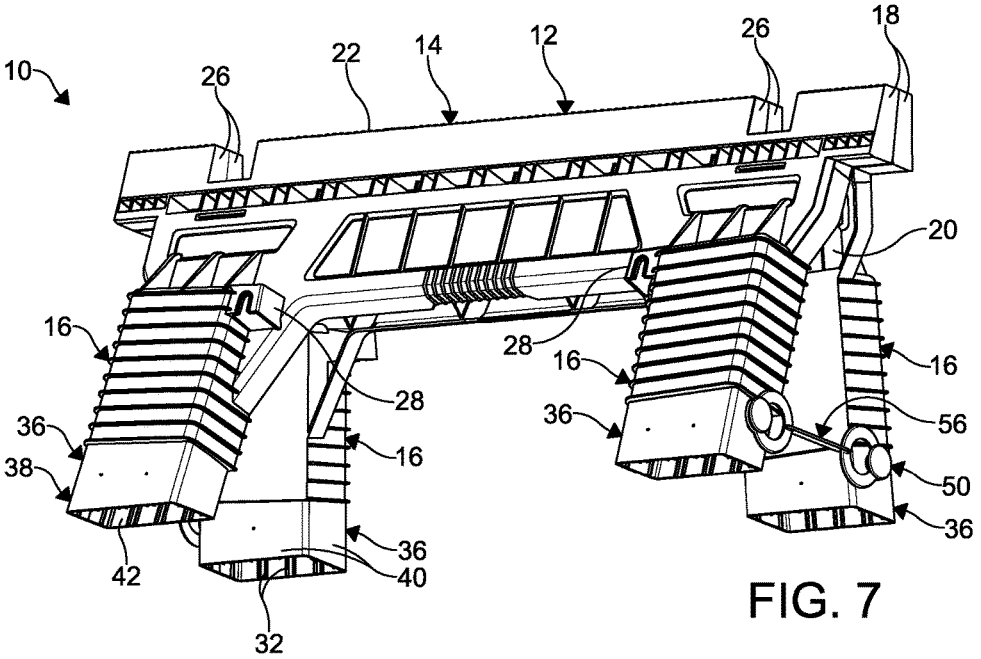
FIG. 7 is another perspective view of the sawhorse according to the instant disclosure, the sawhorse shown in a condensed arrangement.
Figure 8:
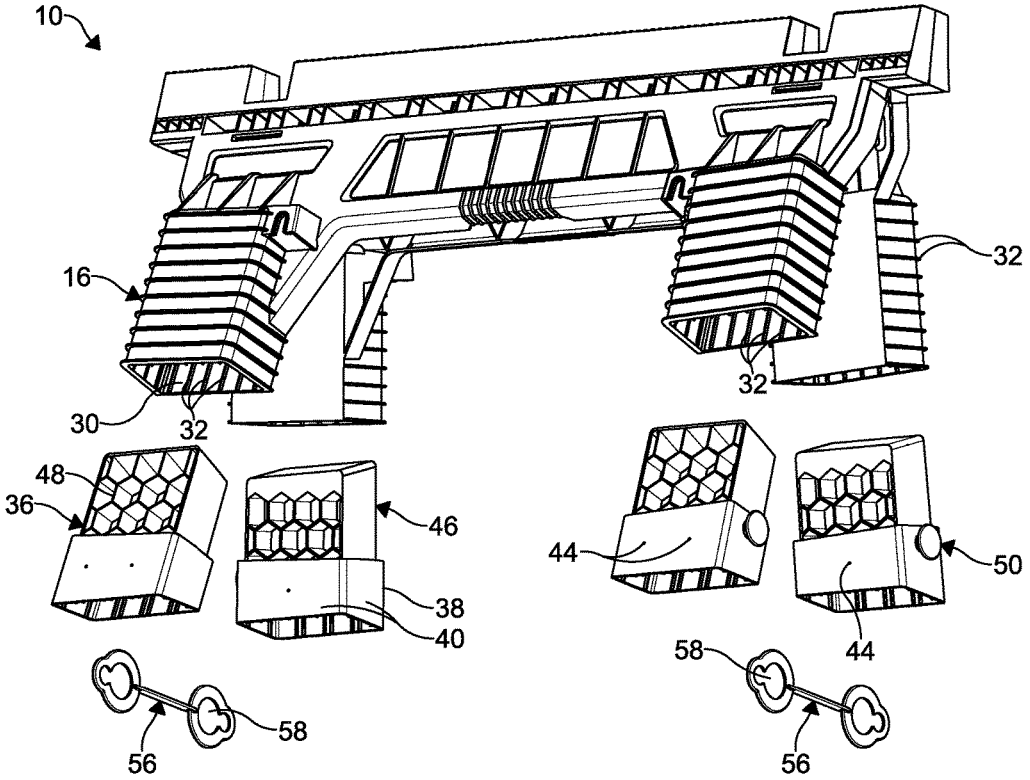
FIG. 8 is an exploded perspective view of the sawhorse shown in FIG. 7.
Figure 9:
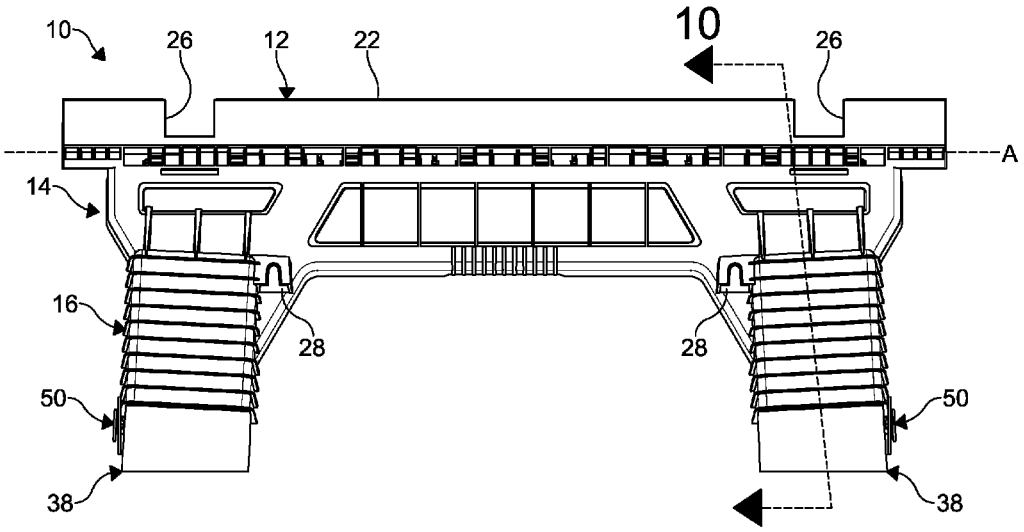
FIG. 9 is a right side elevational view of the sawhorse as shown in FIG. 7.
Figure 10:
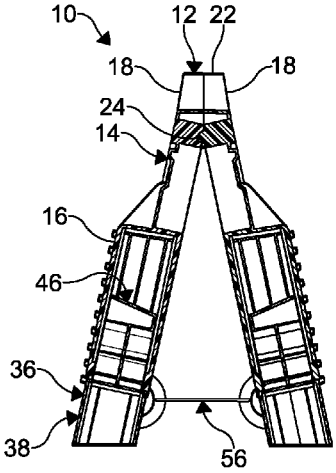
FIG. 10 is a cross-sectional view of the sawhorse taken at section line 10-10 in FIG. 9.

As detailed in FIG. 6, each of the feet 36 may include a receptacle 38 formed at a first end thereof and a plug 46 formed at a second end thereof. A plurality of sidewalls 40 of the receptacle 38 form an opening 42 configured to receive an end of one of the extension members 34 therein. At least one of the sidewalls 40 of the receptacle 38 may include an aperture 44 formed therethrough. The aperture 44 is configured to receive a fastener, such as a nail, screw or pin, therein.

Similar to the cavities 30 of the receiving members 16, the opening 42 may include a plurality of the ribs 32 formed on interior surfaces of the sidewalls 40. The ribs 32 advantageously strengthen the receptacle 38 and minimize deflection. The ribs 32 of the receiving members 16 and the receptacle 38 may also frictionally engage the extension members 34 when the extension members 34 are inserted into the receiving members 16 or the receptacles 38, respectively.

The plug 46 is configured to be received within one of the receiving members 16. The plug 46 includes a rib portion 48 having a plurality of honeycomb-shaped ribs to facilitate a bearing of substantial loads. The use of the honeycomb-shaped ribs has been advantageously found to support most loads that are normally associated with sawhorse use. However, the rib portion 48 can have other shapes, as desired.

Each of the receptacle 38 and the plug 46 may be tapered in length to accommodate for an angle of the A-shaped configuration of the receiving members 16 when the platform 14 is in the open position and the feet 36 are in contact with a floor or a surface. The feet 36 can be formed from plastic by a molding process. However, other suitable materials and processes can be contemplated.

In certain embodiments, each of the feet 36 includes a lug 50 extending outwardly therefrom. As shown, the lug 50 extends from an outer surface of the receptacle 38. However, in alternate embodiments the lug 50 may extend from the plug 46. The lug 50 includes a shaft 52 and a flange 54. The shaft 52 may include an aperture formed therethrough.

As shown in FIGS. 1-5, stabilizing members 56 such as straps or cords can extend between the feet 36 of each pair of the receiving members 16. Opposing ends of the stabilizing member 56 are each configured to releasably couple to the lugs 50 of the feet 36. In the illustrated embodiment, each end of the stabilizing members 56 includes a keyhole-shaped opening 58 having a major diameter configured to receive the flange 54 therethrough, and an eccentrically formed minor diameter configured to receive the shaft 52 of the lug 50 therein. A length of the stabilizing members 56 may be adjustable, fixed, or elastic to accommodate the spacing between the feet 36. It should be appreciated that more than, or less than, two stabilizing members 56 may be employed to urge the pair of the feet 36 of each of the receiving members 16 towards each other, as desired.

In the illustrated embodiment, each of the extension members 34 and the plugs 46 have a first cross section, and each of the cavities 30 of the receiving members 16 and the openings 40 of the receptacles 38 have a second cross section. The first cross section is configured to be received within the second cross section. In particular, the first cross section of the extension member 34 and socket 46 is configured to facilitate a press fit with the second cross section of the receiving member 16 and the receptacle 38 when the saw horse 10 is assembled.

To assemble the sawhorse 10 in the extended arrangement, as illustrated in FIGS. 1-5, the platform 14 is configured in the open position. A desired length of the extension members 34 is selected and a first end of each of the extension members 34 is inserted into the cavity 30 of a corresponding one of the receiving members 16. The second end of each of the extension members 34 is inserted into the opening 42 of the receptacle 38 of one of the feet 36. Nails, screws, or other similar coupling devices can be inserted through the apertures of each of the receptacles 38 to engage and secure the extension members 34, thereby militating against removal of the feet 36 from the extension members 34.

The stabilizing members 56 are coupled to the lugs 50 by inserting the flanges 54 through the major diameters of the keyhole-shaped opening 58. The stabilizing member 56 is then pulled tight by splaying the feet 36 of the sawhorse 10, or by shortening the length of the stabilizing member 56, where the shafts 52 of the lugs 50 are received in the minor diameter to secure the stabilizing member 56. The sawhorse 10 can then be positioned on a surface so that the plugs 46 contact the surface and support the sawhorse 10.

To convert the sawhorse 10 from the extended arrangement to the condensed arrangement, as illustrated in FIGS. 7-10, the extension members 34 are removed from the receiving members 16 and the feet 36. Each of the feet 36 are then inverted, and the plugs 46 are inserted directly into the cavity 30 of each of the receiving members 16. The sawhorse 10 can then be positioned on a surface so that the receptacle 38 contacts the surface and supports the sawhorse 10. The stabilizing members 56 can then be positioned to extend between the feet 36 of each of the receiving members 16 by taking similar steps to those described hereinabove.

The sawhorse 10 can be packaged and sold together as a customizable kit. The main body 12, the extension members 34 in one size or various sizes, the feet 36, and the stabilizing members 56 can be sold together to enable a user to assemble and adjust the sawhorse 10 to desired heights. Fasteners (not shown) can be included with the kit along with other saw cutting materials or tools, as desired.

Advantageously, the sawhorse 10 is readily and easily adjustable from the condensed arrangement for the low-profile or -height applications to the extended arrangement for the high-profile or -height applications. The sawhorse 10 is also easy to assemble and cost effective to manufacture. The rib portion 48 of the plug 46 facilitates even distribution of a load exerted on the plug 46. Further advantages of the sawhorse 10 include the stabilizing member 56, which militates against the receiving members 16, the extension members 34, and the feet 36 splaying apart from each other during assembly and use.

While certain representative embodiments and details have been shown for purposes of illustrating the invention, it will be apparent to those skilled in the art that various changes may be made without departing from the scope of the disclosure, which is further described in the following appended claims.

What is claimed is:

1. An extendable sawhorse configurable from a condensed arrangement to an extended arrangement, comprising:

a main body including a platform and a plurality of receiving members depending from the platform, each of the receiving members having a rectilinear cavity defined by inner walls providing a continuous rectangular perimeter of the cavity; and a plurality of feet, wherein each of the feet has a receptacle body and a plug with a generally flat end, the receptacle body including a rectilinear opening formed therein, wherein the plug extends outwardly from the receptacle body and is diametrically opposed to the opening, wherein in the condensed arrangement the plug of each one of the feet is received in one of the receiving members, wherein in the extended arrangement one of the cavities of the receiving members is configured to receive a first end of an extension member having a uniform rectangular cross section along a longitudinal direction of the extension member, and one of the openings of the receptacle bodies is configured to receive a second end of the extension member, and wherein the inner walls of the cavity generally correspond in size and shape to outer surfaces of each of the plug and the extension member such that the inner walls of the cavity can be frictionally engaged with the outer surfaces of each of the plug and the extension member.

2. The sawhorse of claim 1, including an extension member, wherein the extension member is wood.

3. The sawhorse of claim 2, wherein the extension member is a 2×4 piece of lumber.

4. The sawhorse of claim 1, wherein the platform comprises a pair of support members hingedly coupled to each other along a longitudinal axis, the platform configurable in an open position and a closed position.

5. The sawhorse of claim 4, further comprising a recess formed in an upper surface of each platform.

6. The sawhorse of claim 1, wherein the main body and the feet are formed of a plastic material.

7. The sawhorse of claim 1, further comprising a plurality of ribs formed on the sidewalls of the cavity.

8. The sawhorse of claim 1, further comprising at least one hanging feature formed on main body.

9. An extendable sawhorse, comprising:

a main body including a platform and plurality of receiving members depending from the platform, each of the receiving members having a rectilinear cavity defined by inner walls providing a continuous rectangular perimeter of the cavity; and a plurality of feet, each of the feet having a receptacle, a plug, and a lug, each of the lugs disposed on a side of a corresponding one of the feet, each of the receptacles of the feet including an opening formed therein, and the plug extending outwardly from the receptacle opposite the opening and configured to be received within a one of the receiving members, and a stabilizing member having two opposed ends and configured to be releasably coupled to the feet, wherein each end of the stabilizing member includes a keyhole-shaped opening configured to receive a portion of the lug of one of the feet therein.

10. A kit for an extendable sawhorse configurable from a condensed arrangement to an extended arrangement, comprising:

a main body including a platform and a plurality of receiving members depending from the platform, each of the receiving members having a rectilinear cavity defined by inner walls providing a continuous rectangular perimeter of the cavity; and a plurality of feet, wherein each of the feet has a receptacle body with an opening formed at a first end thereof and a plug with a generally flat end at a second end thereof, wherein the plug extends outwardly from the receptacle body and is diametrically opposed to the opening, wherein in the condensed arrangement the plug of each one of the feet is configured to be received in one of the receiving members, wherein in the extended arrangement one of the cavities of the receiving members is configured to receive a first end of an extension member having a uniform rectangular cross section along a longitudinal direction of the extension member, and one of the openings of the receptacle bodies is configured to receive a second end of the extension member, and wherein the inner walls of the cavity generally correspond in size and shape to outer surfaces of each of the plug and the extension member such that the inner walls of the cavity can be frictionally engaged with the outer surfaces of each of the plug and the extension member.

11. The kit of claim 10, further comprising a stabilizing member configured for coupling to and extending between a pair of the feet to militate against a splaying of the feet.

12. The kit of claim 10, wherein the platform comprises a pair of support members hingedly coupled to each other, wherein the platform is configurable in an open position and a closed position.

13. The kit of claim 10, including an extension member, wherein the main body and the feet are formed of plastic, and the extension member is formed of wood.

* * * * *